US006799334B2

(12) United States Patent
Yu

(10) Patent No.: US 6,799,334 B2
(45) Date of Patent: Oct. 5, 2004

(54) MEN'S BRIEFS

(75) Inventor: Jee-Woo Yu, Seoul (KR)

(73) Assignee: Shevan Co., Ltd., Seoul (KR)

( * ) Notice: Subject to any disclaimer, the term of this patent is extended or adjusted under 35 U.S.C. 154(b) by 0 days.

(21) Appl. No.: 10/381,130

(22) PCT Filed: Sep. 21, 2001

(86) PCT No.: PCT/KR01/01587

§ 371 (c)(1),
(2), (4) Date: May 7, 2003

(87) PCT Pub. No.: WO02/24008

PCT Pub. Date: Mar. 28, 2002

(65) Prior Publication Data

US 2004/0003451 A1 Jan. 8, 2004

(30) Foreign Application Priority Data

Sep. 22, 2000 (KR) ..... 2000-26700 U
Apr. 14, 2001 (KR) ..... 2001-10589 U

(51) Int. Cl.[7] ..... A41B 9/02
(52) U.S. Cl. ..... 2/400; 2/403
(58) Field of Search ..... 2/400–408, 228, 2/238, 67; 604/385.01, 385.09, 393–396, 385.19; 602/67–71, 73

(56) References Cited

U.S. PATENT DOCUMENTS 2,462,195 A * 2/1949 Jacobson ..... 2/406
2,513,039 A * 6/1950 Miller ..... 2/406
2,575,701 A * 11/1951 Artzt ..... 2/402
2,601,602 A * 6/1952 Firsching, Sr. ..... 602/67
3,048,176 A * 8/1962 De Woskin ..... 2/406
3,232,293 A * 2/1966 De Woskin ..... 604/396
3,283,545 A * 11/1966 Aimon ..... 66/177
3,354,880 A * 11/1967 Coughlin ..... 602/67
3,397,696 A * 8/1968 Richard ..... 604/396
3,520,304 A * 7/1970 Flowers ..... 604/396
4,050,462 A * 9/1977 Woon et al. ..... 604/365
4,655,760 A * 4/1987 Morman et al. ..... 604/385.26
5,131,100 A * 7/1992 Atwater et al. ..... 2/405

* cited by examiner

*Primary Examiner*—Gloria M. Hale

(57) ABSTRACT

Disclosed is a men's brief adapted to support wearer's scrota and a phallus separately from each other and to prevent the phallus from coming into contact with a skin on the scrota or a groin area. The men's brief comprises a shrunken section (3) for tightening a boundary between scrota (B) and a phallus (A), which is formed by folding strip shaped portions along a middle longitudinal line and the both side longitudinal lines of its front part surrounding the scrota (B) and the phallus (A) and sewing each of the strip shaped portions longitudinally, a first bulged section (3-1) disposed above the shrunken section (3) and adapted to surround and support the phallus (A), and a second bulged section (3-2) disposed under the shrunken section (3) and adapted to surround and support the scrota (B), wherein the first and the second bulged section (3-1, 3-2) are provided by formation of the shrunken section (3).

8 Claims, 9 Drawing Sheets

MEN'S BRIEFS

TECHNICAL FIELD

The present invention relates to a men's briefs, and more particularly to a men's briefs which is modified in its front surface to comfortably support a boundary region between wearer's scrotum and a phallus thereby assuring a stable wearing condition, and to prevent the phallus from coming into contact with a skin of the scrotum or a groin area despite the wearer's intense activity, thereby preventing dermatitis or eczema due to skin to skin contact.

BACKGROUND ART

In general, men's briefs and trunks, which are classified into underwear, are selectively worn depending on wearer's physique or feeling.

The men's briefs is adapted to tightly fit to a wearer's waist and groin areas by its elasticized bands, and is mostly provided at its front surface with a front opening for allowing its internal space to be ventilated and wearer's phallus to be taken out therethrough.

As shown in FIG. 1, such a men's briefs 1 can provide stable wearing condition to a wearer only where the briefs 1 is worn on the wearer after a wearer's phallus "A" is erected upright such that a glans of the phallus "A" is positioned to point to the wearer's navel. With wearing of the briefs, at a boundary area between the phallus "A" and the scrotum, a delta space, i.e., a trigonal space "S", is provided. However, the trigonal space "S" does not allow the phallus "A" positioned therein to be maintained in its upright position on the middle line of the briefs 1 thereby causing the phallus "A" to be inclined and to droop toward a side or a groin area when the wearer stands up, sits down, walks or runs. By such inclination or drooping, the phallus "A" comes into contact with a skin of a groin or a scrotum "B" region. The contact between the phallus "A" and the region is liable to bring about dermatitis or eczema due to perspiration of a large amount of sweat, particularly in the summer months. Furthermore, the contact between skin surfaces may create bad smell due to the stagnant sweat, thereby causing difficulty in maintaining a sanitary condition.

DISCLOSURE OF THE INVENTION

Accordingly, the present invention has been made keeping in mind the above problems occurring in the prior art, and an object of the present invention is to provide a men's briefs which is intended to comfortably support a boundary region between wearer's scrotum and phallus and thus to prevent the phallus from coming into contact with a skin of the scrotum or a groin area, thereby preventing dermatitis or eczema due to perspiration of sweat by created by skin to skin contact.

In order to accomplish the above object, the present invention provides a men's briefs comprising: a shrunken section composed of crimp portions formed at a front part of the briefs having leg openings, which are formed by crimping the front part along a middle vertical line and side vertical lines located at both sides of the middle vertical line to cause streamlined strip portions to be hidden from the front part and sewing the crimps to be formed into the crimp portions; a first bulged section disposed above the crimp portion and adapted to have a space for receiving the wearer's phallus; and a second bulged section disposed under the crimp portions and adapted to have for receiving the wearer's scrotum.

In another embodiment, the present invention provides a men's briefs comprising: a front part disposed between both leg openings of the briefs and cut out with an area of a certain width corresponding to a boundary portion between a wearer's phallus and scrotum; and a woven fabric cloth attached to the cutout portion of the front part by sewing along the upper and lower edges thereof, which is made of fabric material different from material of the briefs and which does not allow lateral extension.

BEST MODE FOR CARRYING OUT THE INVENTION

This invention will be described in further detail by way of example with reference to FIGS. 2 to 9 of the accompanying drawings.

Figure 1:
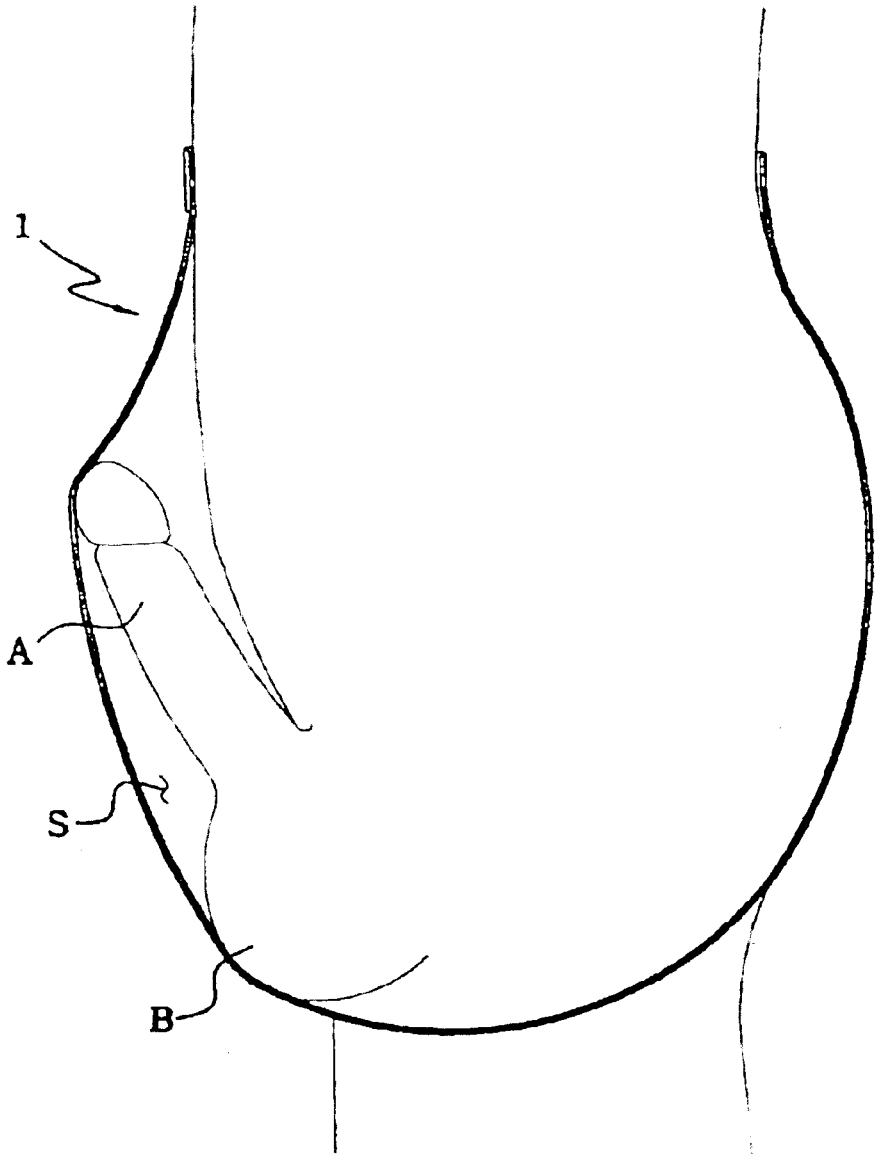
FIG. 1 is a side cross-sectional view showing a conventional men's briefs worn by a wearer.
Figure 2:
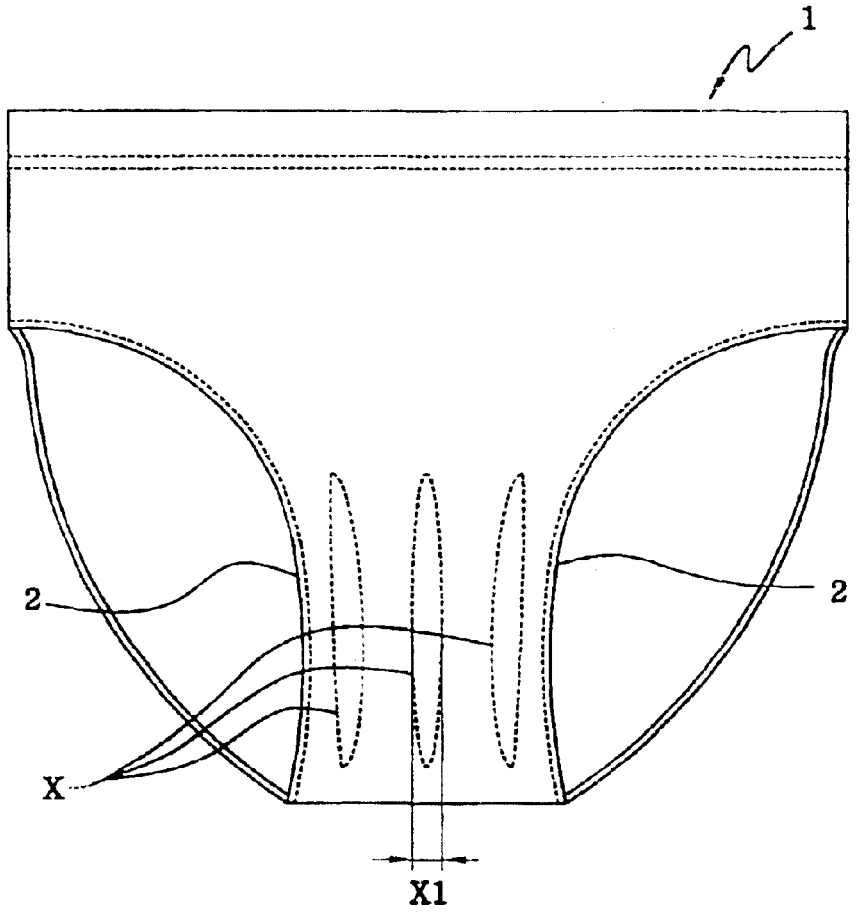
FIG. 2 is a front elevation view showing a men's briefs according to the present invention in which a shrunken section has not yet been formed.
Figure 3:
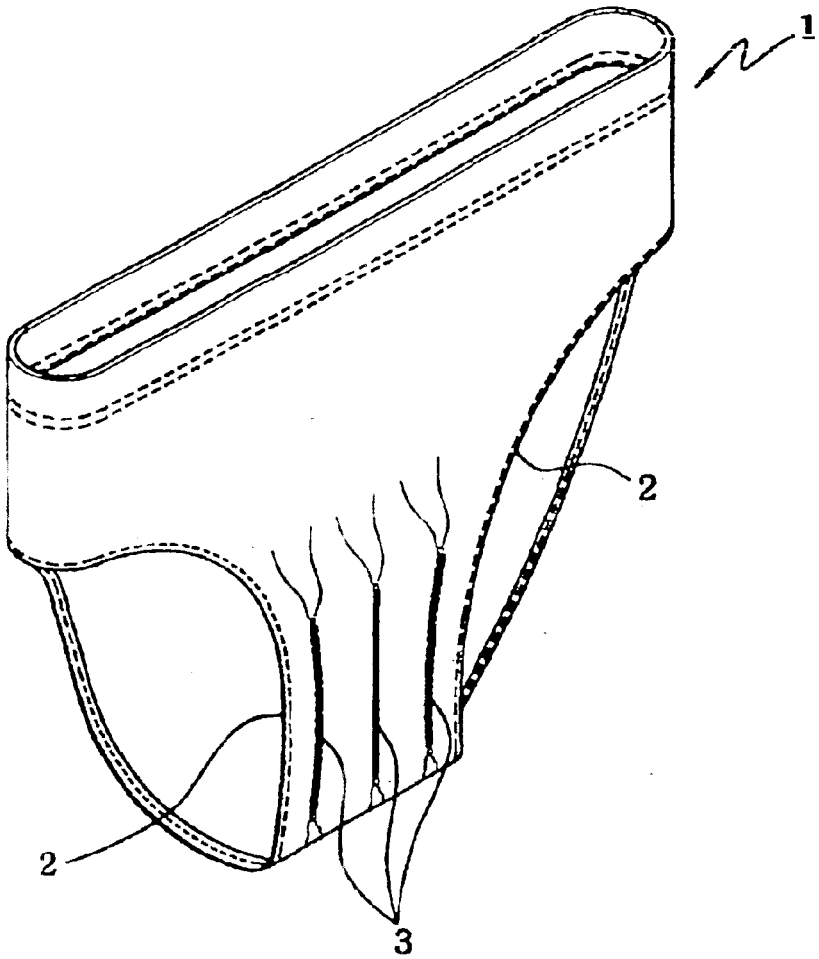
FIG. 3 is a perspective view showing the men's briefs according to the invention in which its front part is sewn at several strip shaped portions to form the shrunken section.
Figure 4:
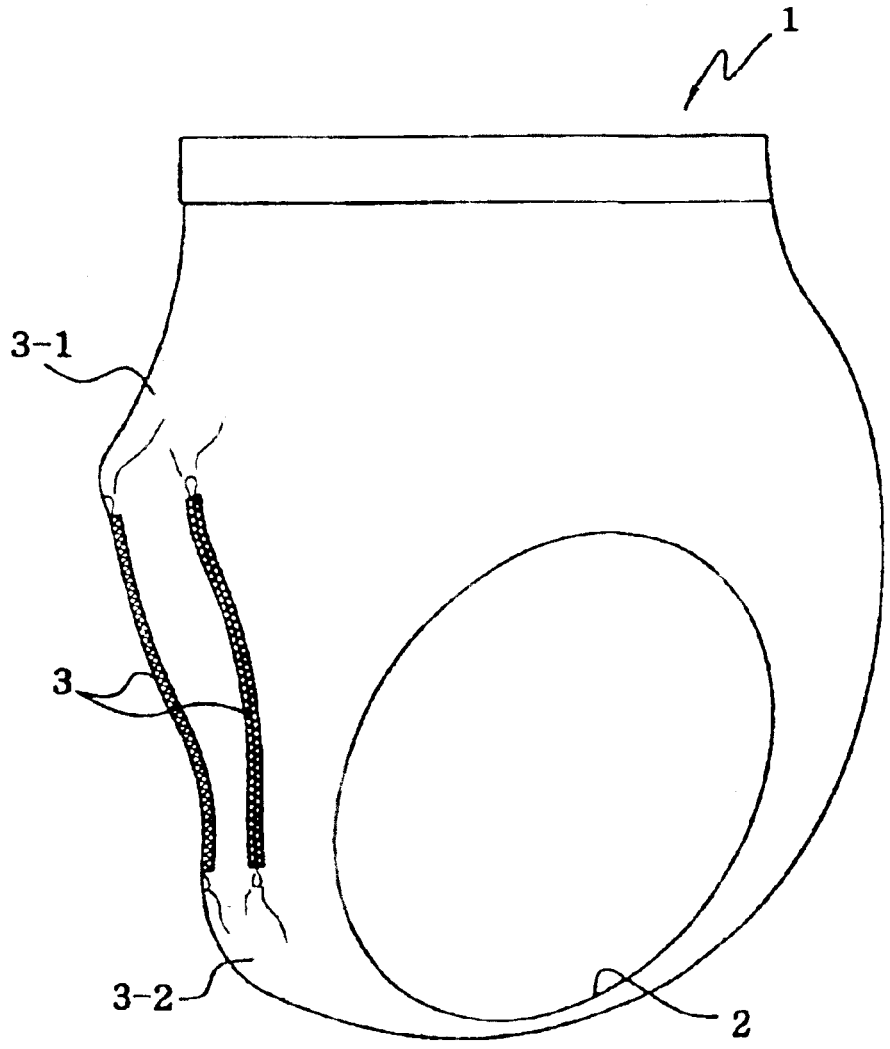
FIG. 4 is a side elevation view showing the men's briefs of FIG. 3 in which the shrunken section is formed.
Figure 5:
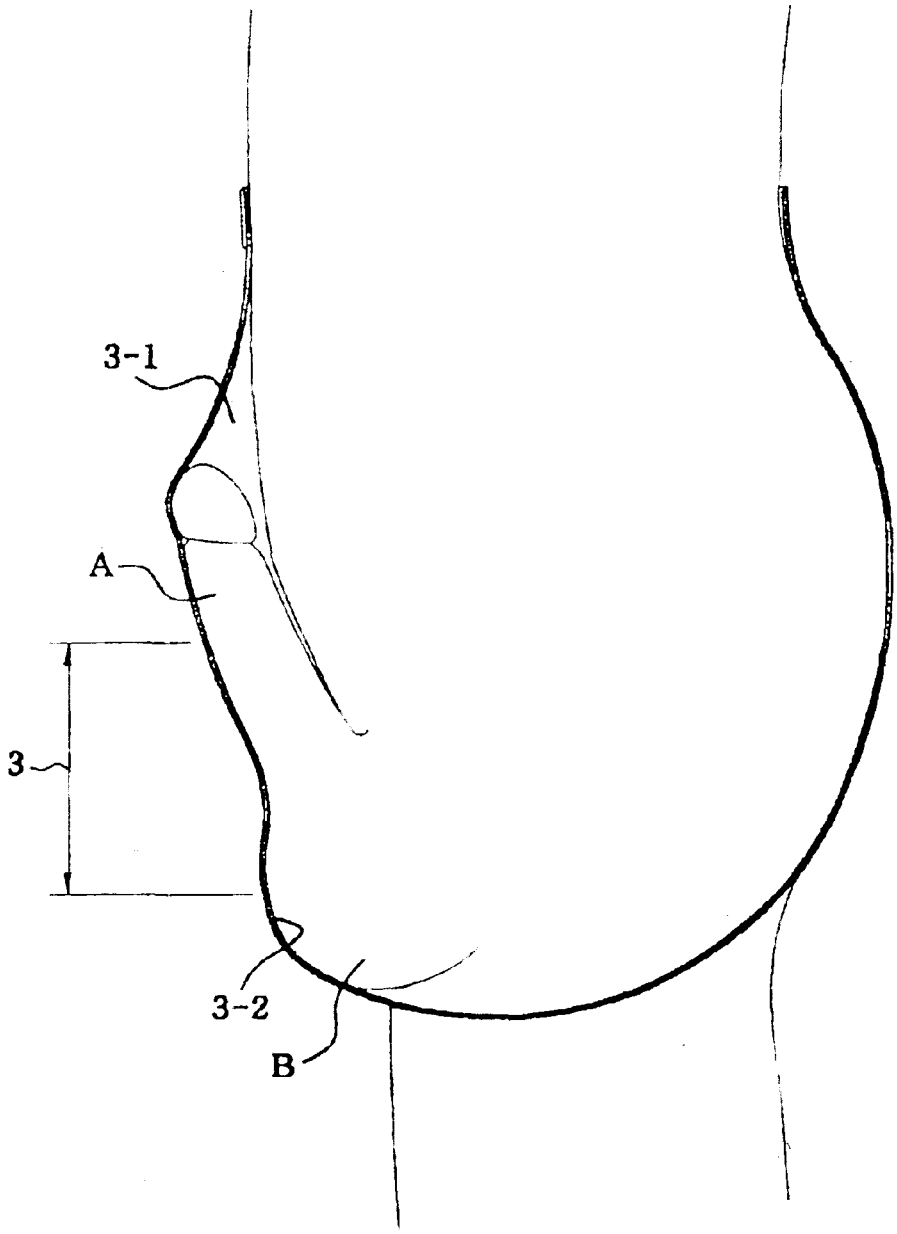
FIG. 5 is a side cross-sectional view showing the men's briefs according to the invention, which is worn by a wearer.

FIG. 2 is a front elevation view showing a men's briefs according to the present invention in which a shrunken section has not yet been formed, FIG. 3 is a perspective view showing the men's briefs according to the invention in which its front part is sewn at several strip shaped portions to form the shrunken section, FIG. 4 is a side elevation view showing the men's briefs of FIG. 3 in which the shrunken section is formed, and FIG. 5 is a side cross-sectional view showing the men's briefs according to the invention which is worn by a wearer.

The men's briefs 1 according to present invention includes a shrunken section composed of crimp portions 3 in a front part between both leg openings 2, which are formed by crimping the front part along a middle vertical line and side vertical lines located at both sides of the middle vertical line to cause streamlined strip portions to be hidden from the front part and sewing the crimps to be formed into crimp portions 3.

In the drawings, reference character "X" designates the outlines of the streamlined strip portions to be formed into the crimp portions, and "X1" designates the widths of the outlines of the streamlined strip portions.

With the formation of the crimp portions, the front part is provided above the crimp portions 3 with a first bulged section 3-1 in which a wearer's erected phallus "A" is positioned, and the front part is provided below the crimp portions 3 with a second bulged section 3-2 in which a wearer's scrotum "B" is stably positioned, when viewed in side elevation.

When viewed in side elevation, protruding degree of the first bulged section 3-1 and the second bulged section 3-2 can be properly selected depending on the widths of the streamlined strip portions defining the crimps to be sewn.

Figure 6:
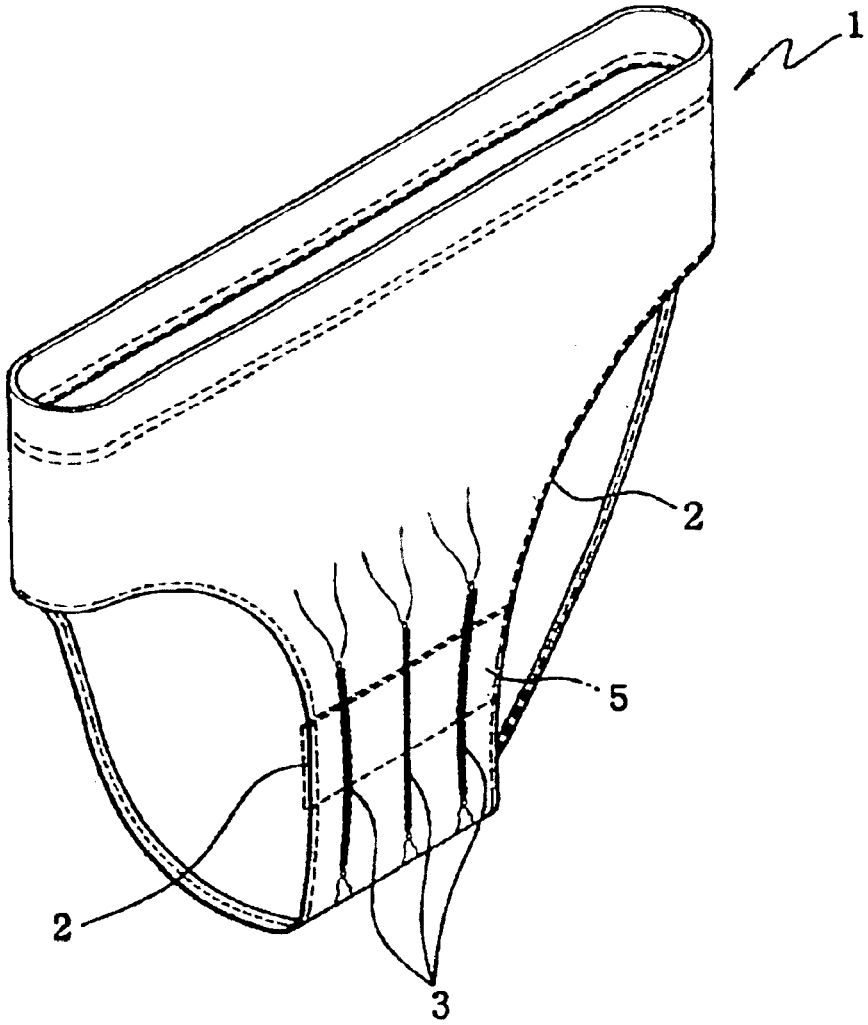
FIG. 6 is a perspective view showing a men's briefs including a reinforcing cloth attached to a rear face.
Figure 7:
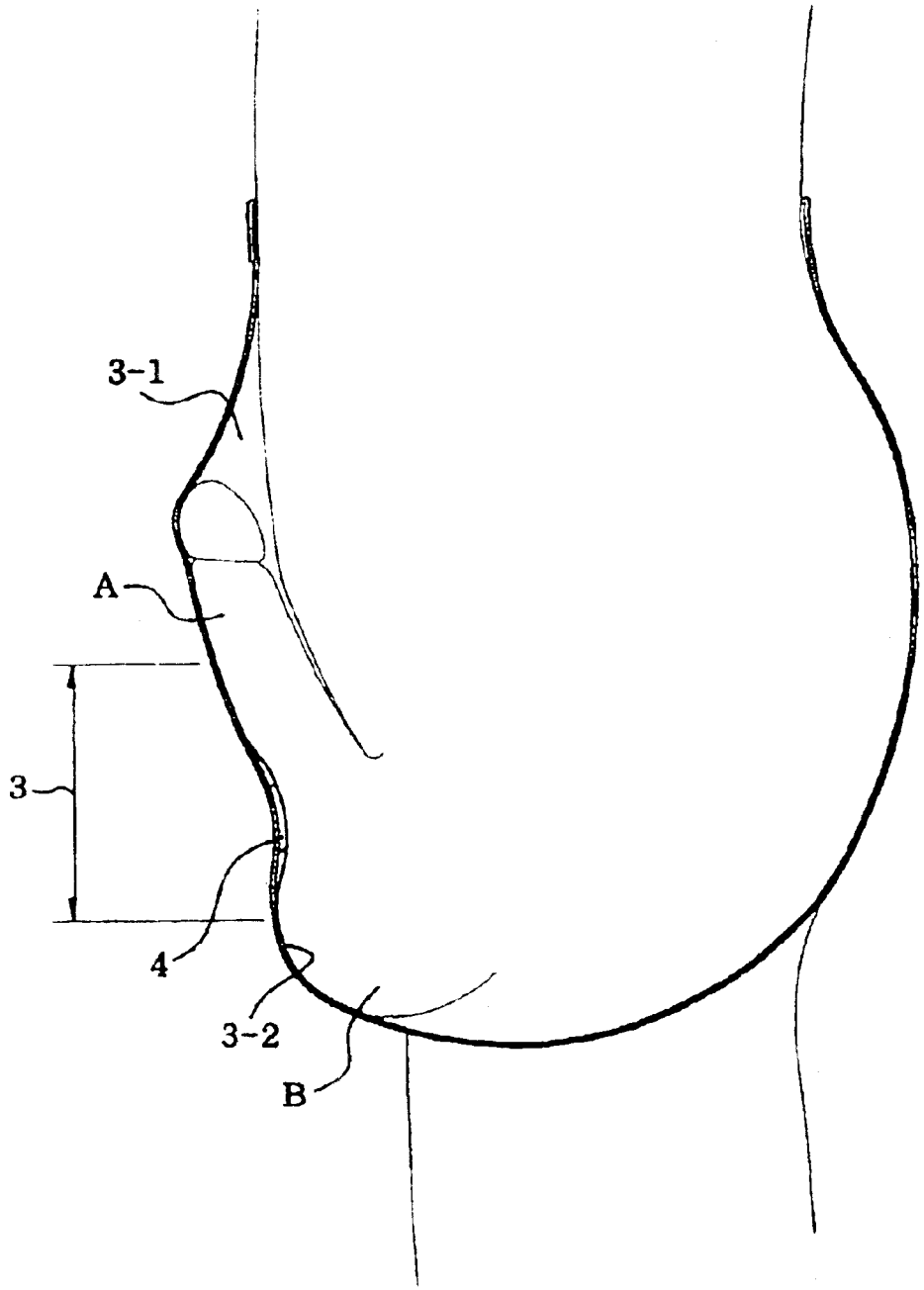
FIG. 7 is a side cross-sectional view of the briefs of FIG. 6, which is worn by a wearer.

Referring to FIGS. 6 and 7 which show a men's briefs according to another embodiment of the present invention, the men's briefs 1 is further provided at the rear face of the front part having the crimp portions 3 with a reinforcing cloth 4 having a certain width. The reinforcing cloth 4 can be attached to the briefs by sewing.

The reinforcing cloth 4 is made of a resilient band, or a cloth woven from material different from that of the briefs, and then is sewn to the briefs. The sewing process is carried out along upper and lower edges of the reinforcing cloth from side edges defining the leg openings 2.

Figure 8:
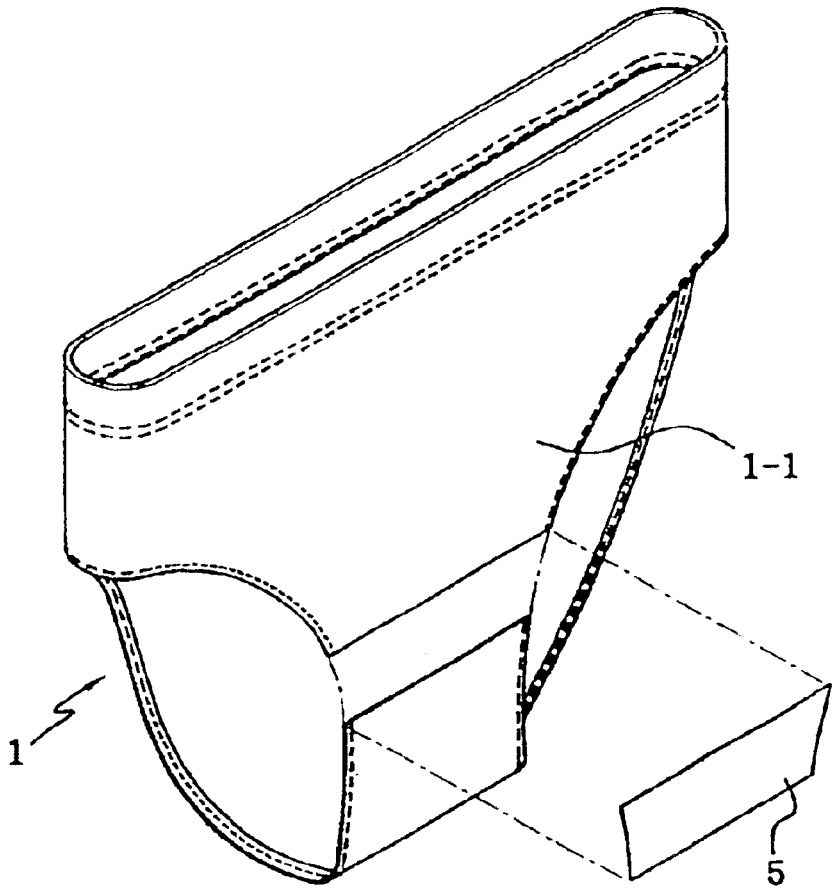
FIG. 8 is a perspective view showing a men's briefs according to another embodiment of the present invention, in which a woven fabric cloth is separated from the briefs.
Figure 9:
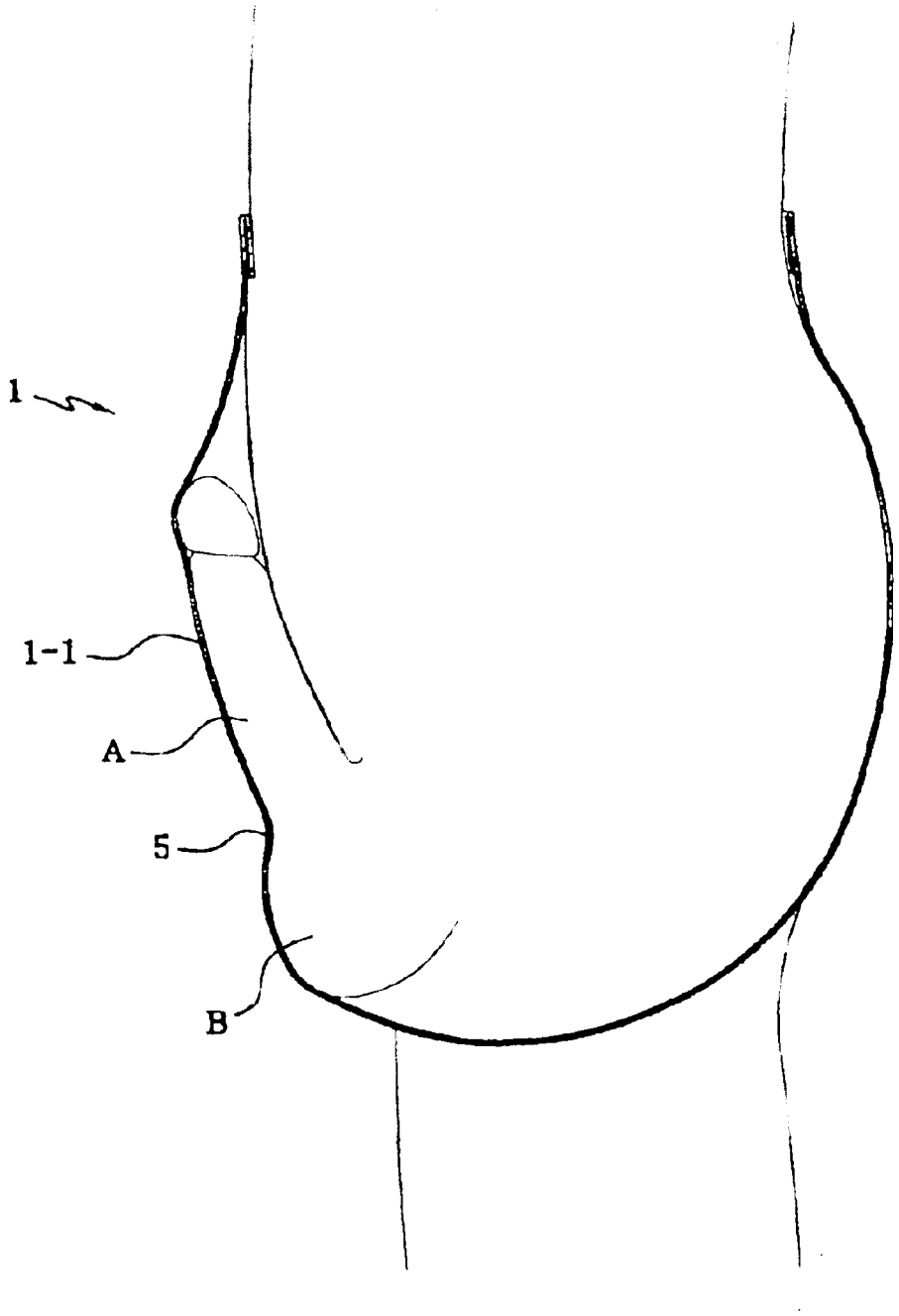
FIG. 9 is a side cross-sectional view of the briefs of FIG. 6, in which a wearer's phallus is erected.

FIGS. 8 and 9 show a men's briefs according to another embodiment of the present invention. As shown in the drawings, the men's briefs 1 is cut out at its front part 1-1 so that the cutout portion is positioned at a boundary portion between a wearer's phallus "A" and scrotum "B" and has a certain width. The cutout portion is attached with a woven fabric pad 5, which cannot be extended laterally, and which is different from the cloth of the briefs 1, by sewing along the upper and lower edges of the woven fabric pad 5. The woven fabric pad 5 can be made of hemp cloth or ramie cloth, and can include a band containing extendable woven fabric, but it is to be noted that material of the woven fabric pad 5 is not limited to the above-listed material.

Functions of the men's briefs according to the present invention, which is configured as described above, will now be described.

The men's briefs 1 is worn by a wearer after the wearer's phallus "A" is erected upright to point to the wearer's navel.

As shown in FIG. 5, when the briefs 1 is worn by a wearer, the wearer's phallus "A" is positioned in the first bulged section 3-1 disposed above the crimp portions 3 formed by a sewing operation of the front part of the briefs 1, and the wearer's scrotum "B" is positioned in the second bulged section 3-2 disposed below the crimp portions 3.

In other words, when the wearer's phallus "A" and scrotum "B" are received in the first bulged section 3-1 and the second bulged section 3-2, respectively, the middle portions of the crimp portions 3 formed at the front part of the briefs 1 stably support a root portion of the phallus "A".

In the men's briefs 1 as shown in FIG. 6, the reinforcing cloth 4 attached to the rear face of the front part having the crimp portions 3 is intended to prevent lateral extension of a portion between both the leg openings 2 which can be caused by repeated washing and wearing. The reinforcing cloth 4 is also intended to preserve initial shapes of the crimp portions 3 for a long time, thereby allowing a wearer's phallus to be supported.

As such, when the briefs is worn by the wearer, the crimp portions 3 and the reinforcing cloth 4 serve to hold a wearer's phallus "A" in order to prevent the wearer's phallus "A" from drooping toward the second bulged section 3-2 from the first bulged section 3-1. Therefore, the crimp portions 3 and the reinforcing cloth 4 can create advantages in that it is possible to eliminate perspiration of sweat caused by direct contact between the phallus and the scrotum as well as the bad smell due to stagnant sweat, and is possible to allow the phallus and the scrotum to be separately held for the sake of sanitary condition, thereby preventing dermatitis or eczema.

In a conventional men's briefs, a trigonal space "S" is provided at a boundary portion between a wearer's phallus and scrotum. The trigonal space "S" of the briefs is eliminated by the crimp portions 3 formed at a front part of the briefs, so that a wearer's phallus "A" is received in the first bulged section 3-1, and scrotum "B" is received in the second bulged section 3-2, thereby allowing stable wearing condition.

In other words, the crimp portions are able to moderately press a root portion of a wearer's phallus, thereby allowing the phallus to be stably supported. For example, the crimp portions function to tighten a wearer's phallus like a waistband of a skirt or a pair of trousers that tightens a wearer's waist to prevent the skirt or the pair of trousers from slipping down.

As such, when the men's briefs is worn by a wearer with a phallus being erected, the crimp portions serve to prevent the phallus from falling down and from coming into direct contact with the wearer's scrotum or groin region, thereby preventing dermatitis or eczema due to stagnant sweat.

When the men's briefs 1 according to another embodiment of the present invention is worn by a wearer as shown in FIGS. 8 and 9, the wearer's phallus "A" is positioned to point to the wearer's navel.

In the above condition, the wearer's phallus "A" is positioned to be inclined forward rather than to be erected upright due to a wearer's bulging pubic bone. At this point, the woven fabric pad 5 attached to the front part 1-1 of the men's briefs can moderately and stably support a boundary area between the wearer's phallus and the scrotum without the trigonal space of a conventional men's briefs.

Since the woven fabric pad 5 serves as a band having a woven fabric structure, which is not extended laterally when viewed in front elevation, the woven fabric pad 5 can maintain the wearer's phallus "A" in erected position while separating the wearer's phallus "A" from the wearer's scrotum. Therefore, it is possible to avoid direct contact between the skin of the phallus and the skin of the scrotum.

The lack of contact between a wearer's phallus and a scrotum prevents perspirations of sweat, bad smell, and dermatitis or eczema due to stagnant sweat thereby allowing a sanitary condition to a wearer.

INDUSTRIAL APPLICABILITY

As described above, the present invention provides a men's briefs which is provided at its front part with a shrunken section composed of crimp portions for moderately supporting a boundary area between a wearer's phallus and scrotum with the phallus being erected to point to the wearer's navel. With the formation of the shrunken section, the front part of the men's briefs is provided above the shrunken section with a first bulged section adapted to receive the wearer's phallus, and is provided below the shrunken section with a second bulged section adapted to receive the wearer's scrotum. In another embodiment of the present invention, a men's briefs is provided at its front part with a fabric pad which is intended to moderately support a boundary area between a wearer's phallus and scrotum while maintaining the phallus to point to the wearer's navel, thereby allowing stable wearing condition. Therefore, the men's briefs of the invention can prevent the wearer's phallus from coming into contact with a skin surface of the scrotum or a groin region, thereby preventing dermatitis or eczema due to stagnant sweat.

What is claimed is:

1. A men's briefs comprising:

a shrunken section composed of crimp portions formed at a front part of the briefs having leg openings, which are formed by crimping the front part along a middle vertical line and side vertical lines located at both sides of the middle vertical line to cause streamlined strip portions to be hidden from the front part and sewing the crimps to be formed into the crimp portions;

a first bulged section disposed above the crimp portions and adapted to have a space for receiving the wearer's phallus; and a second bulged section disposed under the crimp portions and adapted to have a space for receiving the wearer's scrotum.

2. The men's briefs as set forth in claim 1, wherein said shrunken section of said front part of the briefs is provided with a reinforcing cloth attached to a rear face of the front part shrunken section, the reinforcing cloth disposed between both the leg openings and having a certain width.

3. A men's briefs comprising:

a front part of the brief having leg openings, in which a cutout portion is formed on said front part between the leg openings and is of a certain width corresponding to a boundary portion between a wearer's phallus and scrotum; and a woven fabric pad attached to the cutout portion of the front part by sewing along upper and lower edges thereof, which is made of fabric material different from material of the briefs and which is extensible in a non-lateral direction to thereby prevent lateral extension of the front part of the brief between the leg openings in order to maintain a wearer's phallus in an erect position while separating the phallus from the wearer's scrotum.

4. The men's briefs as set forth in claim 3, wherein the woven fabric cloth is made of material selected from the group consisting of hemp and ramie.

5. A men's briefs comprising:

a shrunken section composed of a crimp portion formed at a front part of the briefs having leg openings, which is formed by crimping the front part along vertical lines to cause a streamlined strip portion to be hidden from the front part and sewing the crimps to be formed into the crimp portion;

a first bulged section disposed above the center portion of the crimp portion and adapted to have a space for receiving the wearer's phallus; and a second bulged section disposed under the center portion of the crimp portion and adapted to have a space for receiving the wearer's scrotum.

6. The men's briefs as set forth in claim 5, wherein said shrunken section of said front part of the briefs is provided with a reinforcing cloth attached to a rear face of the front part shrunken section, the reinforcing cloth disposed between both the leg openings and having a certain width.

7. A men's briefs having leg openings comprising:

a shrunken section formed by sewing both sides of a streamlined strip portion which is cut along vertical lines of a front part of the briefs having leg openings;

a first bulged section disposed above a center portion of the shrunken section and adapted to have a space for receiving the wearer's phallus; and a second bulged section disposed under the center portion of the shrunken section and adapted to have a space for receiving the wearer's scrotum.

8. The men's briefs as set forth in claim 7, wherein said shrunken section of said front part of the briefs is provided with a reinforcing cloth attached to a rear face of the front part shrunken section, the reinforcing cloth disposed between both the leg openings and having a certain width.

* * * * *